United States Patent [19]

Maglica

[11] Patent Number: 4,656,565

[45] **Date of Patent: * Apr. 7, 1987**

[54] FLASHLIGHT

[75] Inventor: Anthony Maglica, Ontario, Calif.

[73] Assignee: Mag Instrument, Inc., Ontario, Calif.

[ * ] Notice: The portion of the term of this patent subsequent to Mar. 18, 2003 has been disclaimed.

[21] Appl. No.: 836,975

[22] Filed: Mar. 6, 1986

Related U.S. Application Data

[63] Continuation-in-part of Ser. No. 648,032, Sep. 6, 1984, Pat. No. 4,577,263.

[51] Int. Cl.[4] ..... F21L 7/00

[52] U.S. Cl. ..... 362/187; 362/205; 362/197

[58] Field of Search ..... 362/187, 188, 205, 197, 362/202, 203, 178, 198

[56] References Cited

U.S. PATENT DOCUMENTS

| | | | |
|---|---|---|---|
| 2,097,222 | 10/1937 | Tompkins | 362/187 |
| 2,339,356 | 1/1944 | Sachs | 362/187 |
| 2,490,830 | 12/1949 | Norton | 362/184 |
| 2,599,295 | 6/1952 | Thomas | 362/205 |
| 2,915,621 | 12/1959 | Garland | 362/205 |
| 2,931,005 | 3/1960 | Saurwein | 362/205 |
| 4,203,150 | 5/1980 | Shamlian | 362/183 |
| 4,234,913 | 11/1980 | Ramme | 362/158 |
| 4,261,026 | 4/1981 | Bolha | 362/101 |
| 4,286,311 | 8/1981 | Maglica | 362/205 |
| 4,329,740 | 5/1982 | Colvin | 362/184 |
| 4,388,673 | 6/1983 | Maglica | 362/205 |
| 4,398,238 | 8/1983 | Nelson | 362/184 |
| 4,429,351 | 1/1984 | Petzl | 362/187 |
| 4,472,766 | 9/1984 | Hung | 362/205 |
| 4,577,263 | 3/1986 | Maglica | 362/187 |

FOREIGN PATENT DOCUMENTS

| | | | |
|---|---|---|---|
| 138873 | 4/1948 | Australia | 362/184 |
| 2372382 | 11/1976 | France | 362/184 |

*Primary Examiner*—Ronald B. Cox

*Attorney, Agent, or Firm*—Lyon & Lyon

[57] ABSTRACT

A flashlight includes a barrel for retaining batteries. A reflector and lens located at one end is rotatable axially to vary the reflection dispersion of a light beam emanating through the lens from a lamp bulb. An internal cylindrical sleeve within the barrel provides the electrical path between a tail cap adjacent the one electrode end of the batteries and the end adjacent the reflector, lens, and bulb. The sleeve is a non-ferrous nickel plated material for improved conductivity between component parts.

29 Claims, 5 Drawing Figures

FLASHLIGHT

RELATED APPLICATION

This application is a continuation-in-part of U.S. Ser. No. 648,032 filed Sept. 6, 1984 now U.S. Pat. No. 4,577,263, the contents of which are incorporated by reference herein.

BACKGROUND OF THE INVENTION

The present invention relates primarily to flashlights, and in particular, to a miniature hand-held flashlight.

Flashlights of varying sizes and shapes are well-known in the art. In particular, certain of such known flashlights utilize two or more dry cell batteries, carried in series in a cylindrical tube serving as a handle for the flashlight, as their source of electrical energy. Typically, an electrical current is established from one electrode of the battery through a conductor to a switch, then through a conductor to one electrode of the lamp bulb. After passing through the filament of the lamp bulb, the electrical circuit emerges through a second electrode of the lamp bulb in electrical contact with a conductor, which in turn is in electrical contact with the flashlight housing. The flashlight housing usually provides an electrical conduction path to an electrical conductor, generally a spring element, in contact with the other electrode of the battery. Actuation of the switch to complete the electrical circuit enables electrical current to pass through the filament, thereby generating light which is typically focused by a reflector to form a beam of light.

The production of light from such flashlights has often been degraded by the quality of the reflector utilized and the optical characteristics of any lens interposed in the beam path. Moreover, intense light beams have often required the incorporation of as many as seven dry cell batteries in series, thus resulting in a flashlight having significant size and weight.

Efforts at improving such flashlights have primarily addressed the quality of the optical characteristics. The production of more highly reflective, well-defined reflectors, which may be incorporated within such flashlights, have been found to provide a more well-defined focus thereby enhancing the quality of the light beam produced. Additionally, several advances have been achieved in the light admitting characteristics of flashlight lamp bulbs.

Since there exists a wide variety of uses for hand-held flashlights, the development of the flashlight having a variable focus, which produces a beam of light having a variable dispersion, has been accomplished. However, such advances have heretofore been directed at "full-sized" flashlights.

In a flashlight which is made of metal body such as aluminum many manufacturing processes are necessary to ensure that effective electrical conductivity and contact can be maintained through the metal body. These processes can be relatively expensive steps in the overall manufacturing procedures. Some of these processes require multiple machining, anodizng and degreasing steps of the various metal elements. Moreover, it is desirable to ensure that the electrical conductivity between conductive elements does not deteriorate due to corrosion effects which may be caused by electrolysis through the interaction between different kinds of metal, such as copper and aluminum, which may form part of the electrical circuit.

SUMMARY OF THE INVENTION

It is an object of the present invention to provide a flashlight having improved electrical conductivity and optical characteristics.

It is another object of the present invention to provide a flashlight which is capable of producing a beam of light having a variable dispersion.

It is further object of the present invention to provide a flashlight wherein relative motions of components that produce the variation and the dispersion of the light beam provide an electrical switch function to open and complete the electrical circuit of the flashlight.

According to the invention a flashlight includes a barrel with an internal cylindrical sleeve containing at least two dry cell batteries as disposed in a series arrangement. A lamp bulb holder assembly includes electrical conductors for making electrical contact between electrodes of a lamp bulb held therein and the cylindrical sleeve in the barrel and an electrode of the battery, respectively. A tail cap and spring member encloses one end of the barrel and through the remote end of the sleeve at the tail cap provides an electrical contact to the other electrode of the batteries.

A head assembly which includes a reflector, a lens, and a face cap, is rotatably mounted to the barrel such that the lamp bulb extends through a hole in the center of the reflector within the lens.

Preferably, the batteries are of the size commonly referred to as "pen light" batteries.

The sleeve is of non-ferrous material such as brass and is nickel-plated. This ensures effective conductivity with engaging adjacent parts connected in electrical circuit with the battery electrodes and the spring member in the tail cap.

The head assembly engages threads formed on the exterior of the barrel such that rotation of the head assembly about the axis of the barrel changes the relative displacement between the lens and the lamp bulb. When the head assembly is fully rotated onto the barrel, the reflector pushes against the forward end of the lamp holder assembly causing it to shift rearward within the barrel against the urging of the spring contact at the tail cap. In this position, the electrical conductor within the lamp holder assembly which completes the electrical circuit from the lamp bulb to the barrel is not in contact with the cylindrical sleeve or barrel.

Upon rotation of the head assembly in a direction causing the head assembly to move forward with respect to the barrel, pressure on the forward surface of the lamp holder assembly from the reflector is relaxed enabling the spring contact in the tail cap to urge the batteries and the lamp holder assembly in a forward direction. This brings the electrical conductor into contact with the cylindrical sleeve, thereby completing the electrical circuit and causing the lamp bulb to illuminate. At this point, the lamp holder assembly engages a stop which prevents further forward motion of the lamp holder assembly with respect to the cylindrical sleeve and barrel. Continued rotation of the head assembly in a direction causing the head assembly to move forward relative to the barrel causes the reflector to move forward relative to the lamp bulb. This changes the focus of the reflector with respect to the lamp bulb, which results in varying the dispersion of the light beam admitted through the lens.

By rotating the head assembly until it disengages from the barrel, the head assembly may be placed, lens down, on a substantially horizontal surface and the tail cap and cylindrical tube may be vertically inserted therein to provide a "table lamp."

DETAILED DESCRIPTION

Figure 1:
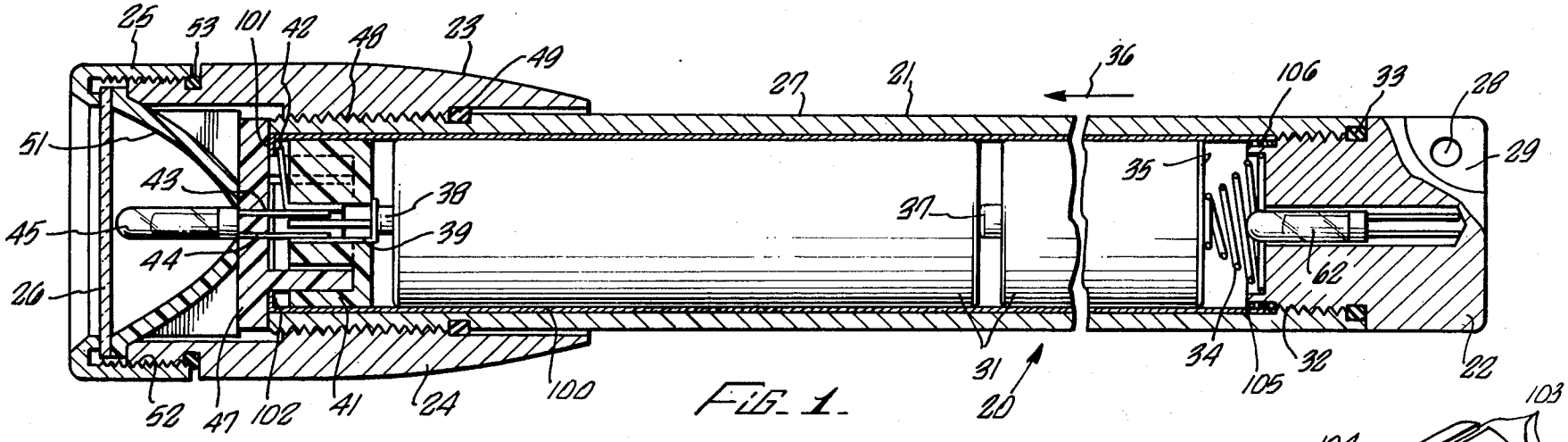
FIG. 1 is a partially foreshortened cross-sectional view of a flashlight with an internal cylindrical sleeve.

The overall construction of the flashlight of FIGS. 1, 2, 4 and 5 is basically similar. In the embodiments of FIGS. 1, 2, 4 and 5, there is an internal cylindrical sleeve. The construction of the flashlight is now described.

A flashlight 20 is comprised of a generally right circular cylinder, or barrel 21, enclosed at a first end by a tail cap 22 and having a head assembly 23 enclosing a second end thereof. The head assembly comprises a head 24 to which is affixed a face cap 25 which retains a lens 26. The head assembly 23 has a diameter greater than that of the barrel 21 and is adapted to pass externally over the exterior of the barrel 21. The barrel 21 provides a machined handle surface 27 along its axial extent. The tail cap 22 is configured to include provision for attaching a handling lanyard through a hole 28 in a tab 29 formed therein.

The barrel 21 has an extent sufficient to enclose at least two miniature dry cell batteries 31 disposed in a series arrangement. The tail cap 22 has a region of external threading 32 which engages matching threads formed on the interior surface of the barrel 21. A sealing element 33, typically in the form of an O-ring, is provided at the interface between the tail cap 22 and the barrel 21 to provide a watertight seal. A spring member 34 is disposed within the barrel 21 so as to make electrical contact with the tail cap 22 and a case electrode 35 of an adjacent battery 31. The spring member 34 also urges the batteries 31 in a direction indicated by an arrow 36. A center electrode 37 of the rearmost battery 31 is in contact with the case electrode of the forward battery 31. The center electrode 38 of the forward battery is urged into contact with a first conductor 39 mounted within a lower insulator receptacle 41. The lower insulator receptacle 41 also has affixed therein a side contact conductor 42. Both the center conductor 39 and the side contact conductor 42 pass through holes formed in the lower insulator receptacle in an axial direction, and both are adapted to frictionally receive and retain the terminal electrodes 43 and 44 of a miniature bi-pin lamp bulb 45.

Figure 3:
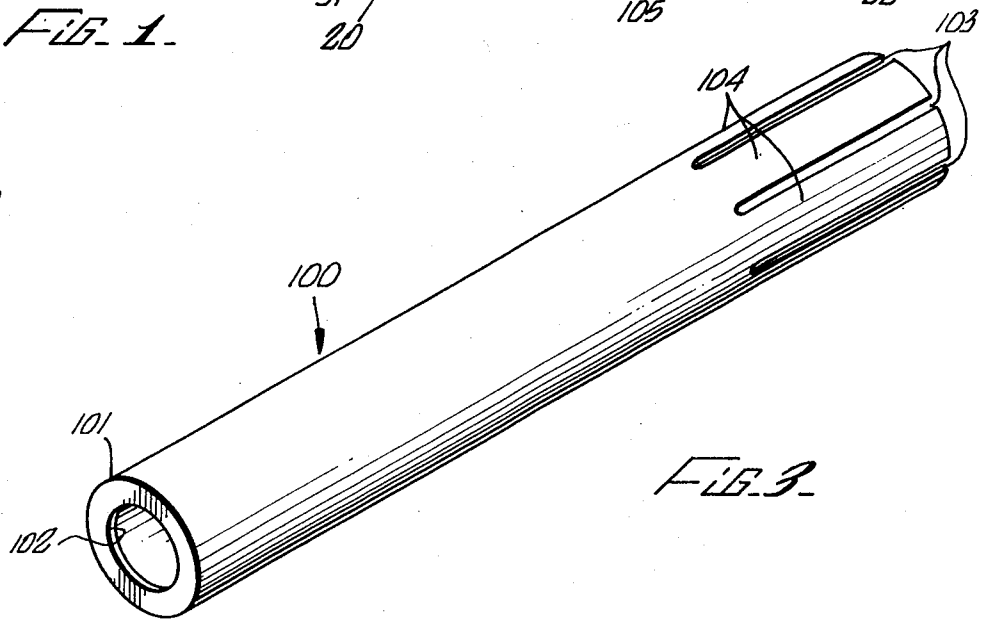
FIG. 3 is a perspective view of a cylindrical internal sleeve for the flashlight.

In FIG. 3 there is illustrated a cylindrical sleeve 100 for location internally inside barrel 21 around the batteries 31. The forward end 101 of the sleeve 100 includes an internally directed circumferential lip 102. The action of the spring 34 is thus to cause contact with the lip 102 of the sleeve 100.

The sleeve 100 is of a non-ferrous material such as brass and is nickel-plated. At the remote end, for location adjacent the tail cap 22 there are spaced slots 103 axially directed to form fingers 104 of a leaf spring. The tail cap 22 includes an inwardly directed annular slot 105 about the periphery of the tail cap 22 adjacent the second electrode of the battery 31. The annular slot 105 accommodates a portion of a spring member 106 so that the fingers 104 of the leaf spring engage the spring member 106 in annular slot 105.

The lower insulator receptacle is urged in the direction indicated by the arrow 36, by the action of the spring 34, to move until. Electrical contact is made between the side contact conductor 42 and the lip 102 of the sleeve 100.

An upper insulator receptacle 47 is disposed external to the end of the barrel 21 whereat the lower insulator receptacle 41 is installed. The upper insulator receptacle 47 has extensions that are configured to mate with the lower insulator receptacle 41 to maintain an appropriate spacing between opposing surfaces of the upper insulator receptacle 47 and the lower insulator receptacle 41. The lamp electrodes 43 and 44 of the lamp bulb 45 pass through the upper insulator receptacle 47 and into electrical contact with the center conductor 39 and the side contact conductor 42, respectively, while the casing of the lamp bulb 45 rests against an outer surface of the upper insulator receptacle 47.

The head assembly 23 is installed external to the barrel 21 by engaging threads 48 formed on an interior surface of the head 24 engaging with matching threads formed on the exterior surface of the barrel 21. A sealing O-ring 49 is installed around the circumference of the barrel 21 adjacent the threads to provide a watertight seal between the head assembly 23 and the barrel 21. A substantially parabolic reflector 51 is configured to be disposed within the outermost end of the head 24, whereat it is rigidly held in place by the lens 26 which is in turn retained by the face cap 25 which is threadably engaged with threads 52 formed on the forward portion of the outer diameter of the head 24. An O-ring 53 may be incorporated at the interface between the face cap 25 and the head 24 to provide a water-tight seal.

When the head 24 is fully screwed onto the barrel 21 by means of the threads 48, the central portion of the reflector 51 surrounding a hole formed therein for passage of the lamp bulb 45, is forced against the outermost surface of the upper insulator receptacle 47, urging it in a direction counter to that indicated by the arrow 36.

The upper insulator receptacle 47 then pushes the lower insulator receptacle 41 in the same direction, thereby providing a space between the forwardmost surface of the lower insulator receptacle 41 and the lip 102 of the sleeve 100 in the embodiments on the forward end of the barrel 21. The side contact conductor 42 is thus separated from contact with the lip 102 on the sleeve 101.

Appropriate rotation of the head 24 about the axis of the barrel 21 causes the head assembly 23 to move in the direction indicated by the arrow 36 through the engagement of the threads 48. Upon reaching the relative positions indicated in FIG. 2 by the solid lines, the head assembly 23 has progressed a sufficient distance in the direction of the arrow 36 such that the reflector 51 has also moved a like distance, enabling the upper insulator receptacle 47 and the lower insulator receptacle 41 to be moved, by the urging of the spring 34 translating the batteries 31 in the direction of the arrow 36.

In this position, the side contact conductor 42 has been brought into contact with the lip 102 of the sleeve 100 at the forward end of the barrel 21, which closes the electrical circuit.

Figure 2:
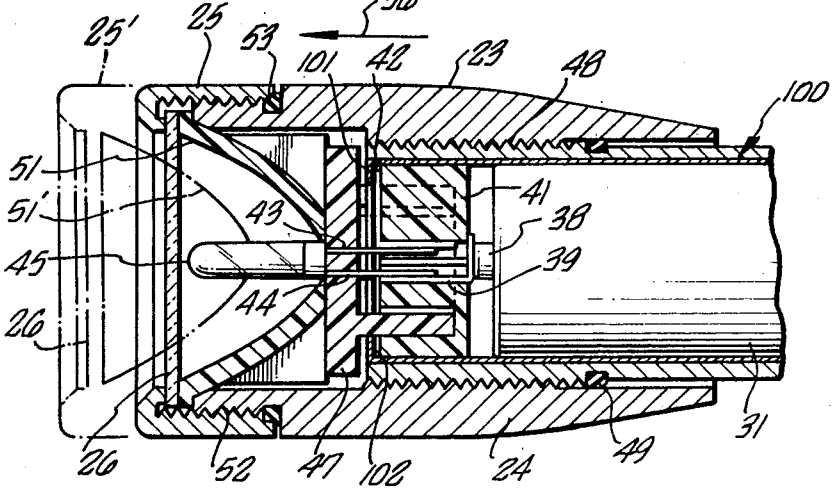
FIG. 2 is a partial cross-sectional view of a forward end of a flashlight of FIG. 1, illustrating, in ghost image, a translation of the forward end of the flashlight.

Further rotation of the head assembly 23 so as to cause further translation of the head assembly 23 in the direction indicated by the arrow 36 will result in the head assembly 23 reaching a position indicated by the ghost image of FIG. 2, placing the face cap at the position 25' and the lens at the position indicated by 26', which in turn carries the reflector 51 to a position 51'. During this operation, the upper insulator receptacle 47 remains in a fixed position relative to the barrel 21. Thus the lamp bulb 45 also remains in a fixed position. The shifting of the reflector 51 relative to the lamp bulb 45 during this additional rotation of the head assembly 23 produces a relative shift in the position of the filament of the lamp bulb 45 with respect to a focus of the parabola of the reflector 51, thereby varying the dispersion of the light beam emanating from the lamp bulb 45 through the lens 26.

Figure 4:
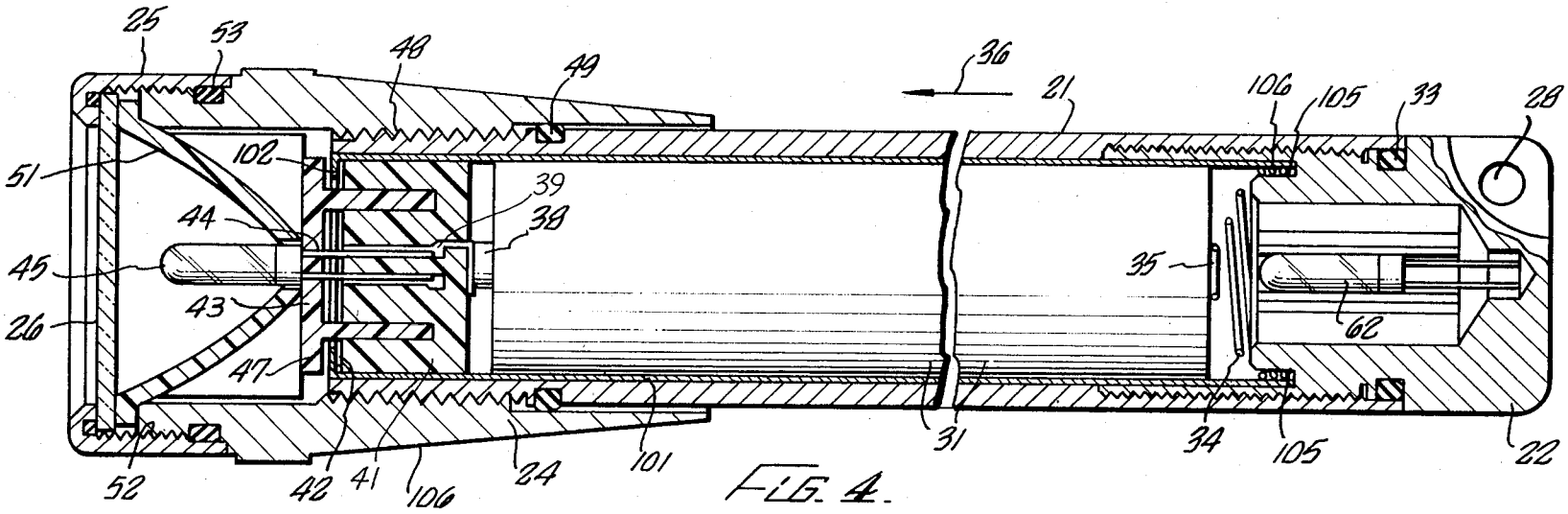
FIG. 4 is a partial foreshortened cross-sectional view of a flashlight with an internal cylindrical sleeve and with a head assembly having a gradually tapering outside surface.

In the embodiment of FIG. 4, the head assembly 23 is shaped in a gradual taper 106 towards the tail cap 22 over an extent substantially greater than half the length of the head assembly 23. The taper 106 is substantially even and gradual.

Figure 5:
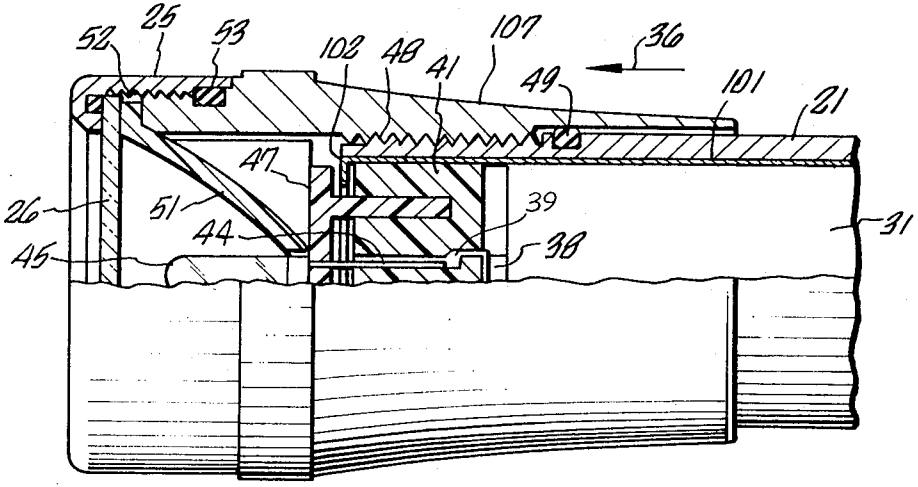
FIG. 5 is a partial foreshortened cross-sectional view of a portion of a flashlight with an internal sleeve and with a head assembly having a gradually tapering concave outside surface.

In the embodiment of FIG. 5, the head assembly 23 is shaped in a gradual concave taper 107 towards the tail cap 22 over an extent substantially greater than half of the length of the head assembly 23. The taper 107 is a substantially evenly directed concave formation.

Referring to the embodiments of FIGS. 4 and 5, the electrical circuit of the flashlight is described. The embodiments of FIGS. 4 and 5 operate in the same way as does the embodiment shown in FIG. 1. Electrical energy is conducted from the rearmost battery 31 through its center contact 37, not shown in FIGS. 4 and 5, which is in contact with the case electrode of the forward battery 31. Electrical energy is then conducted from the forward battery 31 through its center electrode 38 to the center contact 39 which is coupled to the lamp electrode 44. After passing through the lamp bulb 45, the electrical energy emerges through the lamp electrode 43 which is coupled to the side contact conductor 42. When the head assembly has been rotated about the threads 48 to the position illustrated in FIG. 1, the side contact conductor 42 does not contact the lip 102 of the cylinder sleeve 100, thereby resulting in an open electrical circuit.

When the head assembly 23 is rotated about the threads 48 to a position further from the tail cap 22, the side contact conductor 42 is pressed against the lip 102 by the lower insulator receptacle 41 being urged in the direction of the arrow 36 by the spring 34. In this configuration, electrical energy flows from the side contact conductor 42 into the lip 102, through the sleeve 101, into spring 106 and into the tail cap 22. The spring 34 electrically couples the tail cap 22 to the case electrode 35 of the rearmost battery 31. By rotating the head assembly 23 about the threads 48 such that the head assembly 23 moves in a direction counter to that indicated by the arrow 36, the head assembly 23 is restored to the position illustrated in FIG. 1, thereby opening the electrical circuit and turning off the flashlight.

By rotating the head assembly 23 about the threads 48 in a direction causing the head assembly 23 to translate relative to the barrel 21 in the direction of the arrow 36 the electrical circuit is closed as previously described, and the lamp bulb 45 is illuminated. Continued rotation of the head assembly 23 in that direction enables the head assembly 23 to be completely removed from the forward end of the flashlight 20. By placing the head assembly 23 upon a substantially horizontal surface such that the face cap 25 rests on the surface, the tail cap 22 of the flashlight 20 may be inserted into the head 24 to hold the barrel 21 in a substantially vertical alignment. Since the reflector 51 is located within the head assembly 23, the lamp bulb 45 omits a substantially spherical illumination, thereby providing a "ambient" light level.

In a preferred embodiment, the barrel 21, the tail cap 22, the head 24, and the face cap 25, forming all of the exterior metal surfaces of the miniature flashlight 20 are manufactured from aircraft quality, heat-treated aluminum, which is anodized for corrosion resistance. The sealing O-rings 33, 49, and 53 provide atmospheric sealing of the interior of the flashlight 20 to a depth of 200 feet. All interior electrical contact surfaces are appropriately machined to provide efficient electrical conduction.

With the nickel-plated sleeve 100 there is effective conductivity between the various nickel components of the electrical circuit without the exposure to corrosion by electrolysis which would otherwise occur with contact between different method such as, for instance, aluminum and copper. The sleeve 100 avoids many of the manufacturing, degreasing and anodizing steps which would be otherwise necessary for the aluminum body and tail cap.

The reflector 51 is a computer generated parabola which is vacuum aluminum metallized to ensure high precision optics. The threads 48 between the head 24 and the barrel 31 are machined such that revolution of the head assembly 23 through less than ¼ turn will close the electrical circuit, turning the flashlight on. Additional turning will adjust the light beam from a "spot" to a "soft flood". A spare lamp bulb 62 may be provided in a cavity machined in the tail cap 22.

While I have described preferred embodiments of the invention, numerous modifications, alterations, alternate embodiments, and alternate materials may be contemplated by those skilled in the art and may be utilized in accomplishing the present invention. All such alternate embodiments are considered to be within the scope of the present invention as defined by the appended claims. In one such alternative, instead of a complete cylindrical internal sleeve 100, there could be a conductive element running down the inside of the barrel 21 with a suitable contact between a lip-type formation or contact at the forward end of the barrel 21 and the side contact conductor 42, and a contact with the tail cap 22.

I claim:

1. A flashlight comprising:

a barrel for retaining at least one dry cell battery;

a lamp bulb;

means for holding the lamp bulb;

a substantially parabolic reflector;

a substantially planar lens;

means for retaining the reflector and the lens located at one end of the barrel and removably attached thereto, said retaining means being adapted to be controllably axially translatable along the barrel such that the relative positional relationship between the reflector and the lamp bulb may be varied, thereby varying a reflection dispersion of a light beam emanating through the lens from said lamp bulb; a tail cap being engageable with the barrel at the end remote from the means for retaining the reflector and lens;

means for electrically coupling a first electrode of the battery to a first electrode of the lamp bulb; and a conductive element within the barrel, said element being for electrically coupling a second electrode of the lamp bulb to a second electrode of the battery, said second electrode being located adjacent said tail cap; and wherein relative motion of the means for retaining the reflector and the lens in an axial direction towards the barrel for retaining the battery causes opening of the electrical coupling of at least one electrode of the lamp bulb with its respectively coupled battery electrode.

2. A flashlight as claimed in claim 1 wherein the conductive element is a cylindrical sleeve within the barrel so that the battery can be located in the sleeve.

3. A flashlight as claimed in claim 2 wherein the lamp bulb is a bi-pin lamp bulb, each electrode of the lamp bulb being an elongated pin extending from the lamp bulb.

4. A flashlight as claimed in claim 2, including a receptacle for location within the barrel between the barrel end adjacent the means for retaining the reflector, the lamp bulb being mounted such that the lamp bulb electrodes are mounted in the receptacle; and conductor elements in the receptacle for electrically connecting the lamp bulb electrodes with the battery electrodes, one such conductor element being for connecting with the battery terminal through the sleeve, and the other conductor element being for connecting with the center of the battery electrode.

5. A flashlight as claimed in claim 4 wherein the parabolic reflector and planar lens are mounted in a head assembly, such head assembly being threadably engageable with a radially exterior surface of the barrel at the second end of the barrel, said reflector having a central hole formed therein adapted to enable the passage of the lamp bulb therethrough.

6. A flashlight as claimed in claim 5 wherein the threading engagement of the head assembly is axially translated to vary the position of the reflector with respect to the lamp bulb, thereby providing a change of focus of the light beam emanating from the lamp bulb.

7. A flashlight as claimed in claim 6, wherein the sleeve includes an inwardly directed lip at the end for location adjacent the reflector and means on said receptacle for electrically connecting said second electrode of the lamp bulb with said lip, and wherein axial translation of the head assembly along the barrel toward the tail cap end of the barrel causes the receptacle to move and thereby separate said electrically connecting means from the lip of the sleeve thereby interrupting the electrical circuit of the flashlight.

8. A flashlight as claimed in any one of claims 1 to 7, wherein the tail cap includes a spring member, said tail cap being threadably engageable with the barrel, and the spring member urging the dry cell battery toward the opposite end of the barrel.

9. A flashlight as claimed in claim 8, wherein the barrel is adapted to receive at least two dry cell batteries in a series electrical contact.

10. A flashlight as claimed in claim 9 wherein the tail cap is adapted to retain a spare lamp bulb.

11. A flashlight as claimed in claim 7 wherein the end of the sleeve remote from the lip includes spaced axial slots at spaced intervals to form fingers of a leaf spring.

12. A flashlight as claimed in claim 11 wherein the tail cap includes an inwardly directed annular slot about the periphery of the tail cap adjacent the second electrode of the battery, said slot being for accommodating a spring member and wherein the leaf spring engages the spring member in the slot.

13. A flashlight as claimed in claim 2 wherein the sleeve is of a non-ferrous material.

14. A flashlight as claimed in claim 13 wherein the sleeve is a brass composition.

15. A flashlight as claimed in claim 13 wherein the non-ferrous material is nickel plated.

16. A flashlight as claimed in claim 7 wherein the head assembly includes an outer surface shaped in a gradual taper towards the tail cap end over an extent substantially greater than half the length of the head assembly.

17. A flashlight as claimed in claim 7 wherein the head assembly includes an outer surface shaped in a gradual concave taper towards the tail cap end over an extent substantially greater than half the length of the head assembly.

18. A flashlight comprising:

a barrel for retaining at least two dry cell batteries in series connection;

a bi-pin lamp bulb with electrodes of the lamp bulb being an elongated pin extending from the bulb;

means for holding the lamp bulb;

a substantially parabolic reflector;

a substantially planar lens; means for retaining the reflector and the lens located at one end of the barrel, said retaining means being adapted to be controllably axially translatable along the barrel such that the relative positional relationship between the reflector and the lamp bulb may be varied, thereby varying a reflection dispersion of a light beam emanating through the lens from said lamp bulb;

a tail cap being engageable with the barrel at the end remote from the means for retaining the reflector and lens;

means for electrically coupling a first electrode of the batteries to a first electrode of the lamp bulb; and a sleeve within the barrel so that the batteries can be located in the sleeve, said sleeve being for electrically coupling a second electrode of the lamp bulb to a second electrode of the batteries, said second electrode being located adjacent said tail cap; and wherein relative motion of the means for retaining the reflector and the lens in an axial direction towards the barrel for retaining the batteries causes opening of the electrical coupling of at least one electrode of the lamp bulb with its respectively coupled battery electrode.

19. A flashlight as claimed in claim 18, wherein the sleeve includes an inwardly directed lip at the end for location adjacent the reflector and a conductor element secured to said receptacle is adapted to electrically connect said second electrode of the lamp bulb with said lip, and wherein axial translation of the head assembly along the barrel toward the tail cap end of the barrel causes the receptacle to move and thereby separate the conductor element from the lip of the sleeve thereby interrupting the electrical circuit of the flashlight.

20. A flashlight as claimed in claim 19 wherein the end of the sleeve remote from the lip includes spaced axial slots at spaced intervals to form fingers of a leaf spring.

21. A flashlight as claimed in claim 20 wherein the tail cap includes an inwardly directed annular slot about the periphery of the tail cap adjacent the second electrode of the batteries, said slot being for accommodating a portion of the spring member and wherein the leaf spring engages the spring member in the slot.

22. A flashlight as claimed in claim 7 wherein the sleeve is of a non-ferrous nickel-plated material.

23. A flashlight as claimed in claim 1 wherein said conductive element comprises a separate component from said barrel having different material properties.

24. A flashlight as claimed in claim 23 wherein said means for holding the lamp bulb maintains the lamp bulb filament axially beyond the barrel end wherein relative motion of the means for retaining the reflector and the lens in an axial direction away from the barrel will eventually separate said means from the barrel and thereby expose the lamp bulb for dispersion of substantially spherical illumination.

25. A flashlight as claimed in claim 1 wherein the barrel includes a conductive material comprising the conductive element and said means for holding the lamp bulb maintains the lamp bulb filament axially beyond the barrel and wherein relative motion of the means for retaining the reflector and the lens in an axial direction away from the barrel will eventually separate said means from the barrel and thereby expose the lamp bulb for dispersion of substantially spherical illumination.

26. A flashlight comprising:

a barrel for retaining in series a plurality of dry cell batteries;

a bi-pin lamp bulb with each electrode of the lamp bulb being an elongated pin extending from the bulb;

receptacle means at a first end of the barrel for holding the lamp bulb;

a reflector;

a lens;

a head assembly for retaining the reflector and the lens adjacent the first end of the barrel and being removably attached to said first end of the barrel, said head assembly being adapted to be controllably axially translatable along the barrel such that the relative positional relationship between the reflector and the lamp bulb may be varied thereby varying a reflection dispersion of a light beam emanating through the lens from said lamp bulb;

a tail cap being engageable with the barrel at a second end remote from the head assembly;

means for electrically coupling a first electrode of the battery to a first electrode of the lamp bulb;

a conductive element within the barrel, said conductive element being for electrically coupling a second electrode of the lamp bulb to a second electrode of the battery, said second electrode being located adjacent said tail cap; and wherein relative motion of the head assembly in an axial direction towards the barrel for retaining the batteries causes opening of the electrical coupling of at least one electrode of the lamp bulb with its respectively coupled battery electrode.

27. A flashlight as claimed in claim 26 wherein said conductive element comprises a separate component from said barrel having different material properties.

28. A flashlight as claimed in claim 27 wherein said means for holding the lamp bulb maintains the lamp bulb filament axially beyond the barrelend wherein relative motion of the means for retaining the reflector and the lens of an axial direction away from the barrel will eventually separate said means from the barrel and thereby expose the lamp bulb for dispersion of substantially spherical illumination.

29. A flashlight as claimed in claim 26 wherein the barrel includes a conductive material comprising the conductive element and said means for holding the lamp bulb maintains the lamp bulb filament axially beyond the barrel and wherein relative motion of the means for retaining the reflector and the lens in an axial direction away from the barrel will eventually separate said means from the barrel and thereby expose the lamp bulb for dispersion of substantially spherical illumination.

* * * * *

UNITED STATES PATENT AND TRADEMARK OFFICE

CERTIFICATE OF CORRECTION

PATENT NO. : 4,656,565
DATED : April 7, 1987
INVENTOR(S) : Anthony Maglica

It is certified that error appears in the above-identified patent and that said Letters Patent is hereby corrected as shown below:

Title page,
Item [*] Notice, delete the text stating "The portion of the term of this patent subsequent to Mar. 18, 2003 has been disclaimed." and substitute therefore the following text -- This patent is subject to a terminal disclaimer. --

Signed and Sealed this

Fourth Day of November, 2003

JAMES E. ROGAN
*Director of the United States Patent and Trademark Office*